US005839151A

United States Patent [19]

Whaley

[11] Patent Number: 5,839,151

[45] Date of Patent: Nov. 24, 1998

[54] ICE SCRAPING AND SNOW REMOVAL TOOL

[76] Inventor: Everette Lee Whaley, 3191 Gail Ct., Lithi Springs, Ga. 30057

[21] Appl. No.: 864,048

[22] Filed: May 27, 1997

[51] Int. Cl.[6] ..... A47L 13/02

[52] U.S. Cl. ..... 15/236.05; 15/236.02; 15/236.07; 15/236.08

[58] Field of Search ..... 15/236.01, 236.02, 15/236.05, 236.07, 236.08; 30/169, 172

[56] References Cited

U.S. PATENT DOCUMENTS 4,970,749 11/1990 Priore .
5,101,529 4/1992 Tippie .
5,179,754 1/1993 Stradnick .
5,263,222 11/1993 Johnston, III .

*Primary Examiner*—Terrence Till
*Attorney, Agent, or Firm*—Joseph N. Breaux

[57] ABSTRACT

An ice scraping and snow removal tool that includes a cap shaped main body, a handle extending from an outwardly facing surface of the main body, a radially extending scraper edge portion that extends radially from an edge portion of the main body rim, and a plurality of serrated ice breaking teeth formed into the rim of the main body.

20 Claims, 2 Drawing Sheets

ICE SCRAPING AND SNOW REMOVAL TOOL

TECHNICAL FIELD

The present invention relates to ice removal devices for vehicle windshields and more particularly to an ice scraping and snow removal tool for removing snow and ice from a vehicle windshield that includes a cap shaped main body, a handle extending from an outwardly facing surface of the main body, a radially extending scraper edge portion that extends radially from an edge portion of the main body rim, and a plurality of serrated ice breaking teeth formed into the rim of the main body. In a particularly preferred embodiment the ice scraping and snow removal tool further includes a plurality of ice breaking spikes that extend downwardly from a top cavity defining surface of the ice scraping and snow removal tool to a predetermined point above the rim edge of the cap shaped main body and the main body is formed from a plastic that is sufficiently bendable to allow a force placed onto the handle to deform the main body sufficiently to cause the tip ends of the ice breaking spikes to move toward a plane defined by the rim edge of the cap shaped main body.

BACKGROUND OF THE INVENTION

Ice buildup on vehicle windshields must typically be removed prior to using the vehicle. Although the vehicle windshield defroster can be used to melt the ice, this method of ice removal can take too long to be practical. It would be a benefit, therefore, to have a tool for rapidly scraping ice and snow from a vehicle windshield. Because the ice covering the windshield can sometimes be detached from the windshield in sheet sized sections it would be a benefit if the ice and snow scraping tool included a beveled edge scraping portion that could be slid between the windshield surface and the ice layer to separate the ice layer from the windshield. Because the ice must often be cracked into a large number of small pieces before effective removal of the ice can be accomplished, it would be a further benefit if the ice and snow scraping tool included a number of ice breaking teeth.

SUMMARY OF THE INVENTION

It is thus an object of the invention to provide an ice scraping and snow removal tool.

It is a further object of the invention to provide an ice scraping and snow removal tool that includes a beveled edge scraping portion.

It is a still further object of the invention to provide an ice scraping and snow removal tool that includes a number of ice breaking teeth.

It is a still further object of the invention to provide an ice scraping and snow removal tool that includes a cap shaped main body, a handle extending from an outwardly facing surface of the main body, a radially extending scraper edge portion that extends radially from an edge portion of the main body rim, and a plurality of serrated ice breaking teeth formed into the rim of the main body.

It is a still further object of the invention to provide an ice scraping and snow removal tool that includes a cap shaped main body; a handle extending from an outwardly facing surface of the main body; a radially extending scraper edge portion that extends radially from an edge portion of the main body rim; a plurality of serrated ice breaking teeth formed into the rim of the main body; and a plurality of ice breaking spikes that extend downwardly from a top cavity defining surface of the ice scraping and snow removal tool to a predetermined point above the rim edge of the cap shaped main body; and wherein the main body is formed from a plastic that is sufficiently bendable to allow a force placed onto the handle to deform the main body sufficiently to cause the tip ends of the ice breaking spikes to move toward a plane defined by the rim edge of the cap shaped main body.

It is a still further object of the invention to provide an ice scraping and snow removal tool that accomplishes some or all of the above objects in combination.

Accordingly, an ice scraping and snow removal tool is provided. The ice scraping and removal tool includes a cap shaped main body, a handle extending from an outwardly facing surface of the main body, a radially extending scraper edge portion that extends radially from an edge portion of the main body rim, and a plurality of serrated ice breaking teeth formed into the rim of the main body.

In a preferred embodiment, the ice scraping and removal tool includes a cap shaped main body; a handle extending from an outwardly facing surface of the main body; a radially extending scraper edge portion that extends radially from an edge portion of the main body rim; a plurality of serrated ice breaking teeth formed into the rim of the main body; and a plurality of ice breaking spikes that extend downwardly from a top cavity defining surface of the ice scraping and snow removal tool to a predetermined point above the rim edge of the cap shaped main body; the main body being formed from a plastic that is sufficiently bendable to allow a force placed onto the handle to deform the main body sufficiently to cause the tip ends of the ice breaking spikes to move toward a plane defined by the rim edge of the cap shaped main body. To increase manufacturing efficiency, the entire ice scraping and snow removal tool is preferably integrally molded from plastic.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
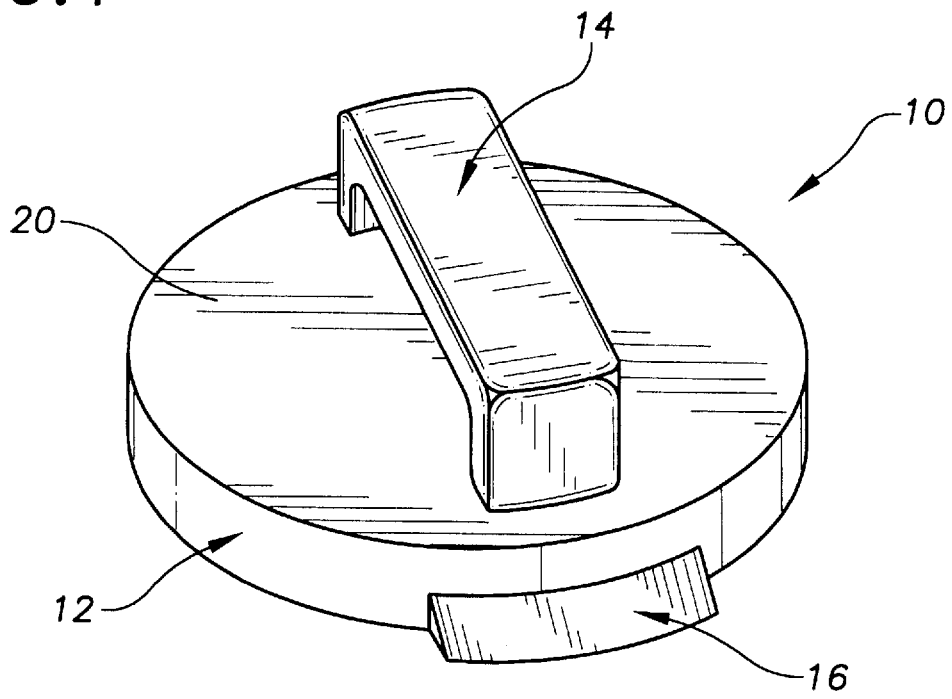
FIG. 1 is a perspective view of a first exemplary embodiment of the ice scraping and snow removal tool of the present invention showing the cap shaped main body, the handle extending from the outwardly facing surface of the main body, and the radially extending scraper edge portion.
Figure 2:
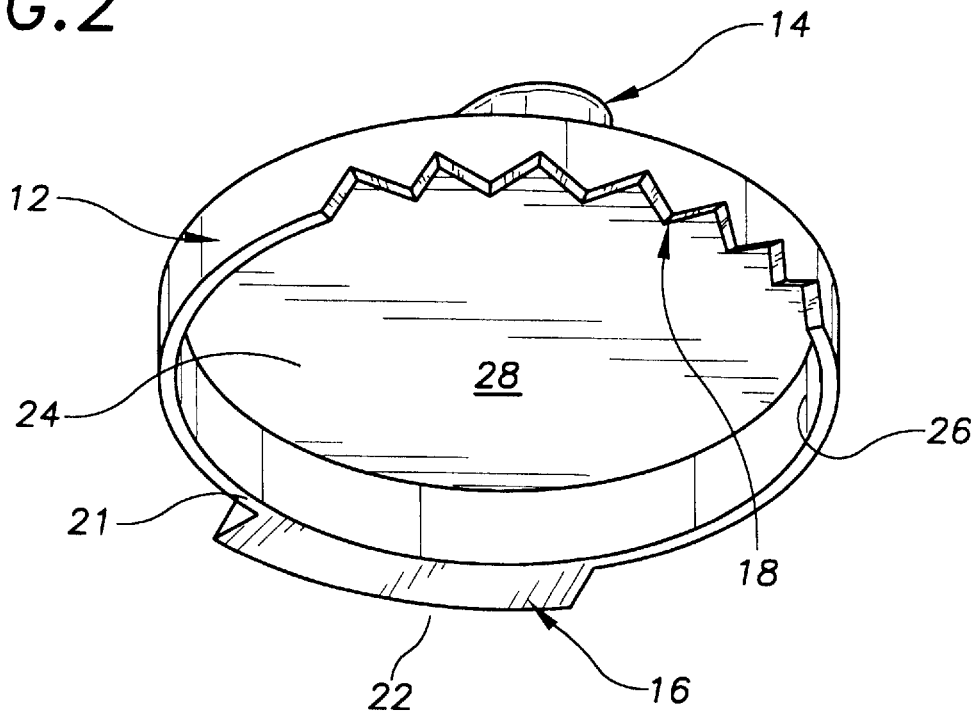
FIG. 2 is a second perspective view of the first exemplary embodiment of the ice scraping and snow removal tool of FIG. 1 showing the interior cavity of the cap shaped main body, the handle, the radially extending scraper edge portion, and the serrated ice breaking teeth formed into the rim of the main body.

FIG. 1 shows a first exemplary embodiment of the ice scraping and snow removal tool of the present invention, generally designated by the numeral 10. Ice scraping and snow removal tool 10 is integrally molded of ABS plastic and includes a cap shaped main body, generally designated 12; a U-shaped handle, generally designated 14; a scraper edge portion, generally designated 16; and a number of triangular shaped, serrated ice breaking teeth, generally designated 18 (FIG. 2). Handle 14 extends from an outwardly facing, circular, disk-shaped surface 20 of main body 12.

With reference to FIG. 2, scraper edge portion 16 extends radially from a rim 21 of main body 12 and includes a beveled scraping edge 22. Main body 12 includes a top cavity defining surface 24 that in conjunction with a circumferential rim segment 26 defines an interior cavity 28 within main body 12. In use, handle 14 is grasped and triangular shaped, serrated ice breaking teeth 18 are used to break the ice covering the vehicle windshield into smaller more easily removed sections. The scraper edge portion 16 is then used to scrape the smaller sections free of the windshield. In some instances large sheets of ice can be easily removed by sliding scraping edge portion 16 between the ice layer and the windshield and removing the ice in a single section.

Figure 3:
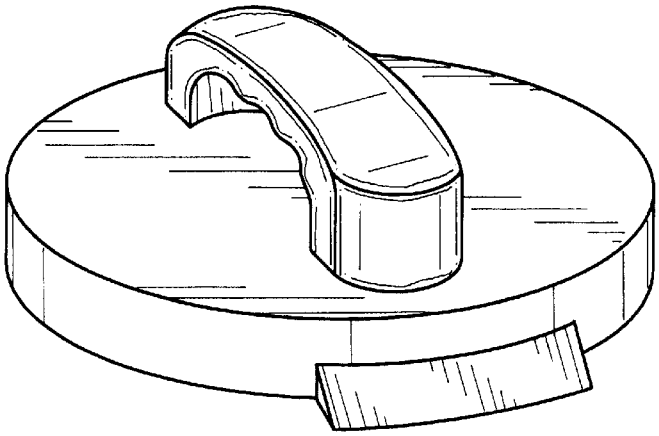
FIG. 3 is a perspective view of a second exemplary embodiment of the ice scraping and snow removal tool of the present invention that is identical to the first embodiment in all respects except the handle portion includes a number of finger receiving indents.

With reference now to FIG. 3, a second embodiment of the ice scraping and snow removal tool of the present invention, generally designated 10*a,* is identical to ice scraping and snow removal tool 10 (FIGS. 1 and 2) except the handle 14*a* includes a number of finger receiving indents 30 to increase the grasp-ability of handle 14*a.*

Figure 4:
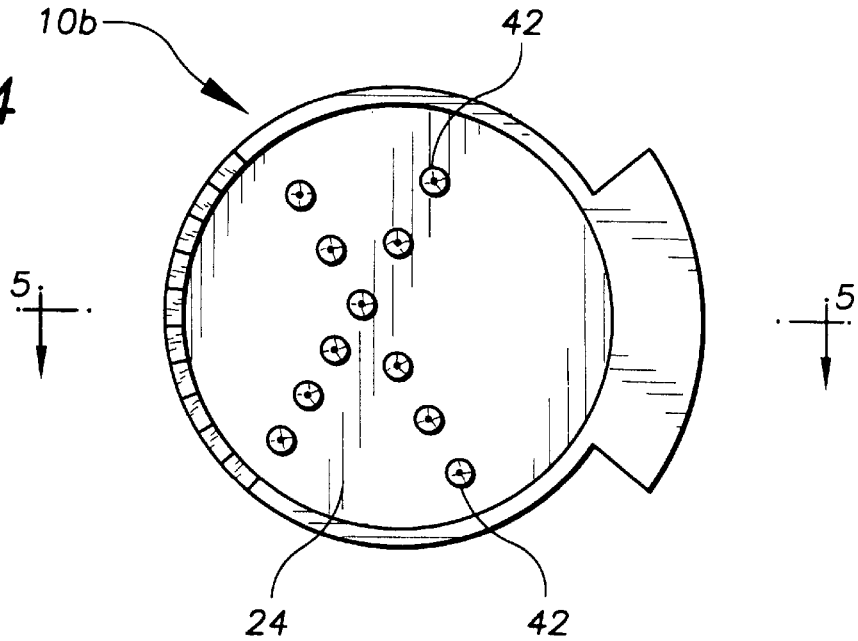
FIG. 4 is an underside plan view of a third exemplary embodiment of the ice scraping and snow removal tool of the present invention showing the interior cavity of the cap shaped main body, the radially extending scraper edge portion, the serrated ice breaking teeth formed into the rim of the main body, and the plurality of ice breaking spikes extending downwardly from the top cavity defining surface of the ice scraping and snow removal tool.
Figure 5:
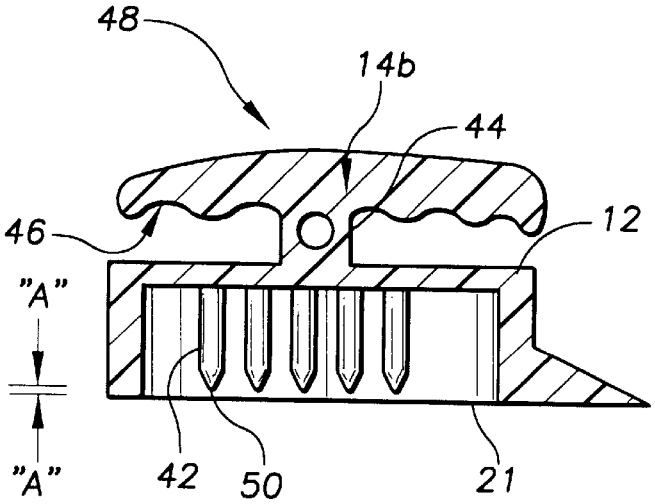
FIG. 5 is a cross section view of the third ice scraping and snow removal tool of FIG. 4 along the line 5—5 showing the interior cavity of the cap shaped main body, the radially extending scraper edge portion, the tip edge of one of the serrated ice breaking teeth formed into the rim of the main body, some of the plurality of ice breaking spikes extending downwardly from the top cavity defining surface of the ice scraping and snow removal tool to a point above the rim edge of the cap shaped main body, and the handle with the centrally positioned main body connecting structure, the finger receiving indentions and the finger receiving aperture.

With reference to FIG. 4, a third exemplary embodiment of the ice scraping and snow removal tool of the present invention, generally designated 10*b*, is identical to ice scraping and snow removal tool 10 (FIGS. 1 and 2) except ice scraping and snow removal tool 10*b* includes a plurality of ice breaking spikes 42 that extend downwardly from top cavity defining surface 24 and, with reference to FIG. 5, the handle 14*b* is T-shaped, is secured to main body 12 with a centrally positioned main body connecting structure 44, and includes a number of finger receiving indentions 46 and a finger receiving aperture 48. Ice breaking spikes 42 each have a tip end 50 that is positioned above rim edge 21 a distance "A" of about one quarter-inch. In this embodiment, main body 12 is formed from a plastic that is sufficiently bendable to allow a force placed onto handle 14*b* to deform main body 12 sufficiently to cause tip ends 50 of ice breaking spikes 42 to move toward a plane defined by rim edge 21. In use this force causes ice breaking spikes 42 to contact ice covering the windshield and assist in breaking the ice into easily removed sections.

It can be seen from the preceding description that an ice scraping and snow removal tool has been provided that includes a beveled edge scraping portion; that includes a number of ice breaking teeth; that includes a cap shaped main body, a handle extending from an outwardly facing surface of the main body, a radially extending scraper edge portion that extends radially from an edge portion of the main body rim, and a plurality of serrated ice breaking teeth formed into the rim of the main body; and that includes a cap shaped main body; a handle extending from an outwardly facing surface of the main body; a radially extending scraper edge portion that extends radially from an edge portion of the main body rim; a plurality of serrated ice breaking teeth formed into the rim of the main body; and a plurality of ice breaking spikes that extend downwardly from a top cavity defining surface of the ice scraping and snow removal tool to a predetermined point above the rim edge of the cap shaped main body; and wherein the main body is formed from a plastic that is sufficiently bendable to allow a force placed onto the handle to deform the main body sufficiently to cause the tip ends of the ice breaking spikes to move toward a plane defined by the rim edge of the cap shaped main body.

It is noted that the embodiment of the ice scraping and snow removal tool described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An ice scraping and snow removal tool comprising:

a cap shaped main body having a main body rim defining an edge;

a handle extending from an outwardly facing surface of said main body;

a radially extending scraper edge portion that extends radially from an edge portion of said main body rim; and a plurality of serrated ice breaking teeth formed into said rim of said main body.

2. The ice scraping and snow removal tool of claim 1, wherein:

said handle is U-shaped.

3. The ice scraping and snow removal tool of claim 2, wherein:

said handle includes a number of finger receiving indents.

4. The ice scraping and snow removal tool of claim 3 wherein:

said serrated ice breaking teeth are triangular shaped.

5. The ice scraping and snow removal tool of claim 4 wherein:

said ice scraping and snow removal tool is integrally molded from plastic.

6. The ice scraping and snow removal tool of claim 3 wherein:

said ice scraping and snow removal tool is integrally molded from plastic.

7. The ice scraping and snow removal tool of claim 2 wherein:

said serrated ice breaking teeth are triangular shaped.

8. The ice scraping and snow removal tool of claim 7 wherein:

said ice scraping and snow removal tool is integrally molded from plastic.

9. The ice scraping and snow removal tool of claim 2 wherein:

said ice scraping and snow removal tool is integrally molded from plastic.

10. The ice scraping and snow removal tool of claim 1, wherein:

said handle includes a number of finger receiving indents.

11. The ice scraping and snow removal tool of claim 10 wherein:

said serrated ice breaking teeth are triangular shaped.

12. The ice scraping and snow removal tool of claim 11 wherein:

said ice scraping and snow removal tool is integrally molded from plastic.

13. The ice scraping and snow removal tool of claim 10 wherein:

said ice scraping and snow removal tool is integrally molded from plastic.

14. The ice scraping and snow removal tool of claim 1 wherein:

said serrated ice breaking teeth are triangular shaped.

15. The ice scraping and snow removal tool of claim 14 wherein:

said ice scraping and snow removal tool is integrally molded from plastic.

16. The ice scraping and snow removal tool of claim 1 wherein:

said ice scraping and snow removal tool is integrally molded from plastic.

17. An ice scraping and snow removal tool comprising:

a cap shaped main body defining a cavity and having a main body rim defining an edge;

a handle extending from an outwardly facing surface of said main body;

a radially extending scraper edge portion that extends radially from an edge portion of said main body rim;

a plurality of serrated ice breaking teeth formed into said rim of said main body; and a plurality of ice breaking spikes that extend downwardly from a top cavity defining surface of said ice scraping and snow removal tool to a predetermined point above said rim edge of said cap shaped main body;

said main body being formed from a plastic that is sufficiently bendable to allow a force placed onto said handle to deform said main body sufficiently to cause tip ends of said ice breaking spikes to move toward a plane defined by said rim edge of said cap shaped main body.

18. The ice scraping and snow removal tool of claim 17, wherein:

said handle is centrally attached to said main body by a main body connecting structure, and said handle includes a number of finger receiving indentions and a finger receiving aperture.

19. The ice scraping and snow removal tool of claim 17, wherein:

said ice scraping and snow removal tool is integrally molded from plastic.

20. The ice scraping and snow removal tool of claim 19, wherein:

said handle is centrally attached to said main body by a main body connecting structure, and said handle includes a number of finger receiving indentions and a finger receiving aperture.

* * * * *